US011208237B1

(12) United States Patent
Hendrickson

(10) Patent No.: US 11,208,237 B1
(45) Date of Patent: Dec. 28, 2021

(54) CONTAINER FOR SELECTIVE DISPLAY

(71) Applicant: Dwight Hendrickson, McDonough, GA (US)

(72) Inventor: Dwight Hendrickson, McDonough, GA (US)

( * ) Notice: Subject to any disclaimer, the term of this patent is extended or adjusted under 35 U.S.C. 154(b) by 0 days.

(21) Appl. No.: 17/153,757

(22) Filed: Jan. 20, 2021

Related U.S. Application Data

(63) Continuation-in-part of application No. 29/762,466, filed on Dec. 16, 2020.

(60) Provisional application No. 63/079,891, filed on Sep. 17, 2020.

(51) Int. Cl.

| | |
|---|---|
| ***B65D 23/08*** | (2006.01) |
| ***B65D 81/18*** | (2006.01) |
| ***B65D 55/02*** | (2006.01) |
| ***B65D 1/02*** | (2006.01) |

(52) U.S. Cl.
CPC ..... *B65D 23/0842* (2013.01); *B65D 1/02* (2013.01); *B65D 55/02* (2013.01); *B65D 81/18* (2013.01)

(58) Field of Classification Search
CPC ..... B65D 23/0842; B65D 23/0857; B65D 23/0885; B65D 25/20; B65D 25/34; B65D 25/36; B65D 25/54; B65D 25/56; B65D 55/02
See application file for complete search history.

(56) References Cited

U.S. PATENT DOCUMENTS

| | | | | |
|---|---|---|---|---|
| 2,895,636 A * | 7/1959 | Martin | ..... | A47G 19/2288 220/574 |
| 4,020,355 A * | 4/1977 | Czaplinski | ..... | G21F 5/015 250/506.1 |
| 9,981,790 B1 | 5/2018 | Ost et al. | | |
| 10,634,428 B1 | 4/2020 | Peter | | |

(Continued)

FOREIGN PATENT DOCUMENTS

KR 20070001151 10/2007

OTHER PUBLICATIONS

HONEYPUFF Aluminum Stash Jar With Thermometer & Hygrometer Airtight Water Proof/Smell Proof Aluminum Herb Container Bottle (Green), https://www.amazon.com/HONEYPUFF-Aluminum-Thermometer-Hygrometer-Container/dp/B07M69W8NR.

(Continued)

*Primary Examiner* — Andrew T Kirsch

(57) ABSTRACT

A container for selective display is an apparatus enabling users to store perishable items under controlled conditions. The apparatus includes a display container and an obstruction mechanism. The display container includes an open container end, a closed container end, a lateral wall, a window, and a sealing lid. The display container is designed to store the items under ideal conditions and facilitates the monitoring and control of the conditions inside the display container. The obstruction mechanism maintains the interior of the display container sealed from exterior light. The open container end enables access to the contents inside the display container. The closed container end and the lateral wall form an enclosed storage space to hold the contents. The window enables the users to inspect the contents without opening the display container. The sealing lid hermetically seals the display container to maintain the ideal conditions for the contents to be preserved.

2 Claims, 8 Drawing Sheets

(56) References Cited

U.S. PATENT DOCUMENTS

| | | | | |
|---|---|---|---|---|
| 2011/0036803 | A1* | 2/2011 | Mejia | B65D 51/28 215/228 |
| 2012/0000918 | A1* | 1/2012 | Deane | B65D 81/3811 220/592.2 |

OTHER PUBLICATIONS

Sure Cure Classic Jar—1/2 oz Smell Proof Jar—Herb Container, Dil Weed Container, Dil Weed Jar, https://www.amazon.com/Sure-Cure-Classic-Jar-Storage/dp/B07L9P4RHH.

Brushed Stainless Steel and Glass Canister with Window, 5"H & 21OZ Set of 3, https://us.amazon.com/dp/B07QJ51MG2/ref=psdc_9833720011_t4_B07NVT7HPB.

* cited by examiner

CONTAINER FOR SELECTIVE DISPLAY

The current application claims a priority to the U.S. provisional application Ser. No. 63/079,891 filed on Sep. 17, 2020.

The current application also claims a priority to the U.S. design application Ser. No. 29/762,466 filed on Dec. 16, 2020.

FIELD OF THE INVENTION

The present invention generally relates to storage containers. More specifically, the present invention is an airtight storage container with wireless capabilities designed to keep the stored contents at ideal environmental conditions.

BACKGROUND OF THE INVENTION

Storage containers are widely available and come in a variety of designs. Some containers are specifically designed to store items that must be stored under certain conditions. For example, various storage containers have been designed to store items under a specific temperature range, light conditions, humidity, etc. In addition, some storage containers have been provided with locking means to prevent unauthorized access. However, some items require additional environment control and have better security to allow authorized access to select users.

The present invention is a container for selective display that enables the user to store items under preconfigured internal conditions while also enabling to users to look at the stored items when desired. The present invention includes a transparent portion that can be selectively concealed so that the users can examine the interior of the container without opening the container. The present invention also provides safety means to prevent unauthorized access into the contents inside the container. Furthermore, the present invention provides means for remote monitoring and control of the environment within the container so that the user can always ensure the contents preservation. Additional features and benefits are further discussed in the sections below.

DETAILED DESCRIPTION OF THE INVENTION

All illustrations of the drawings are for the purpose of describing selected versions of the present invention and are not intended to limit the scope of the present invention.

Figure 1:
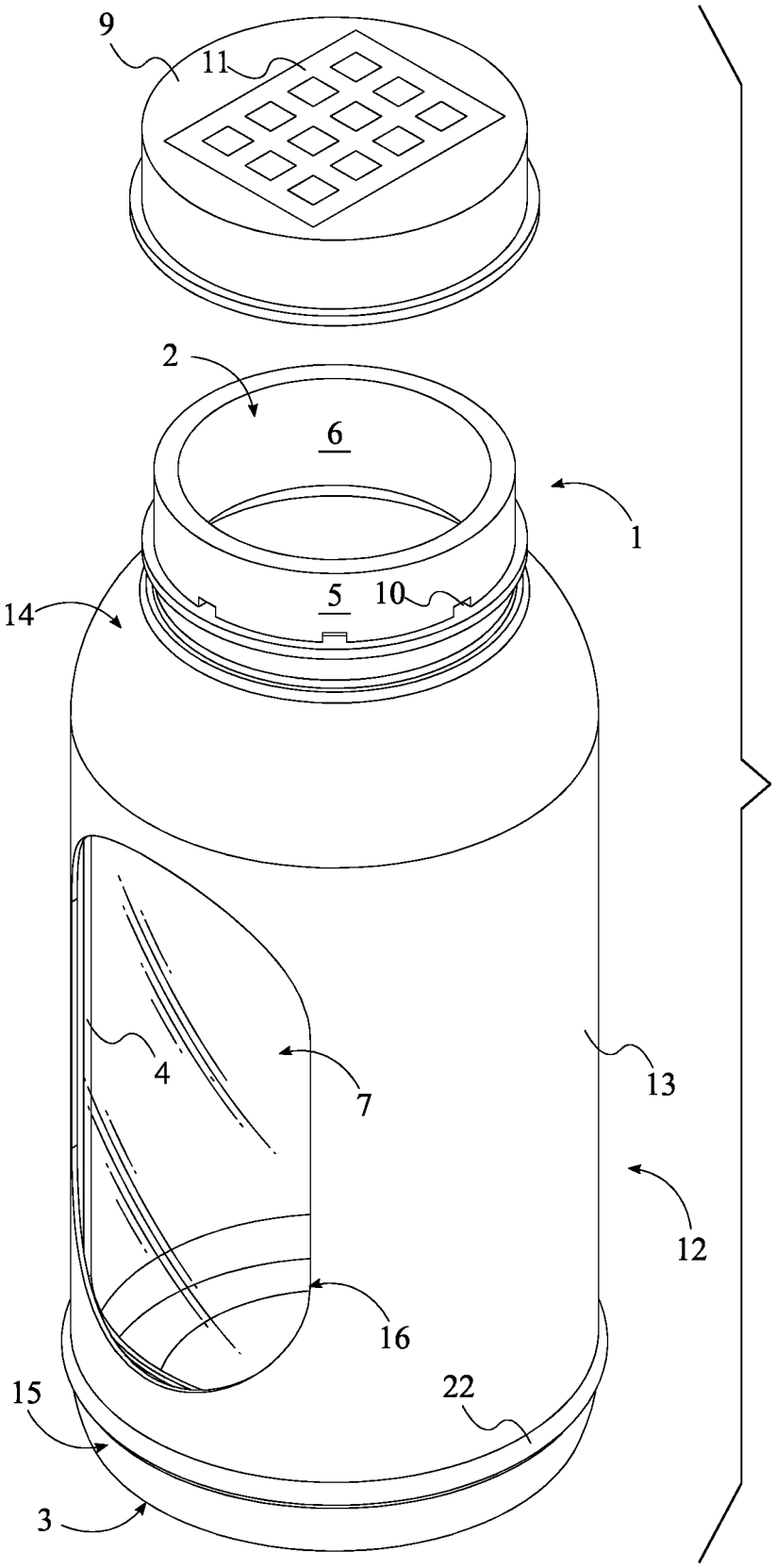
FIG. 1 is a top exploded perspective view showing the sealing lid separated from the display container.
Figure 2:
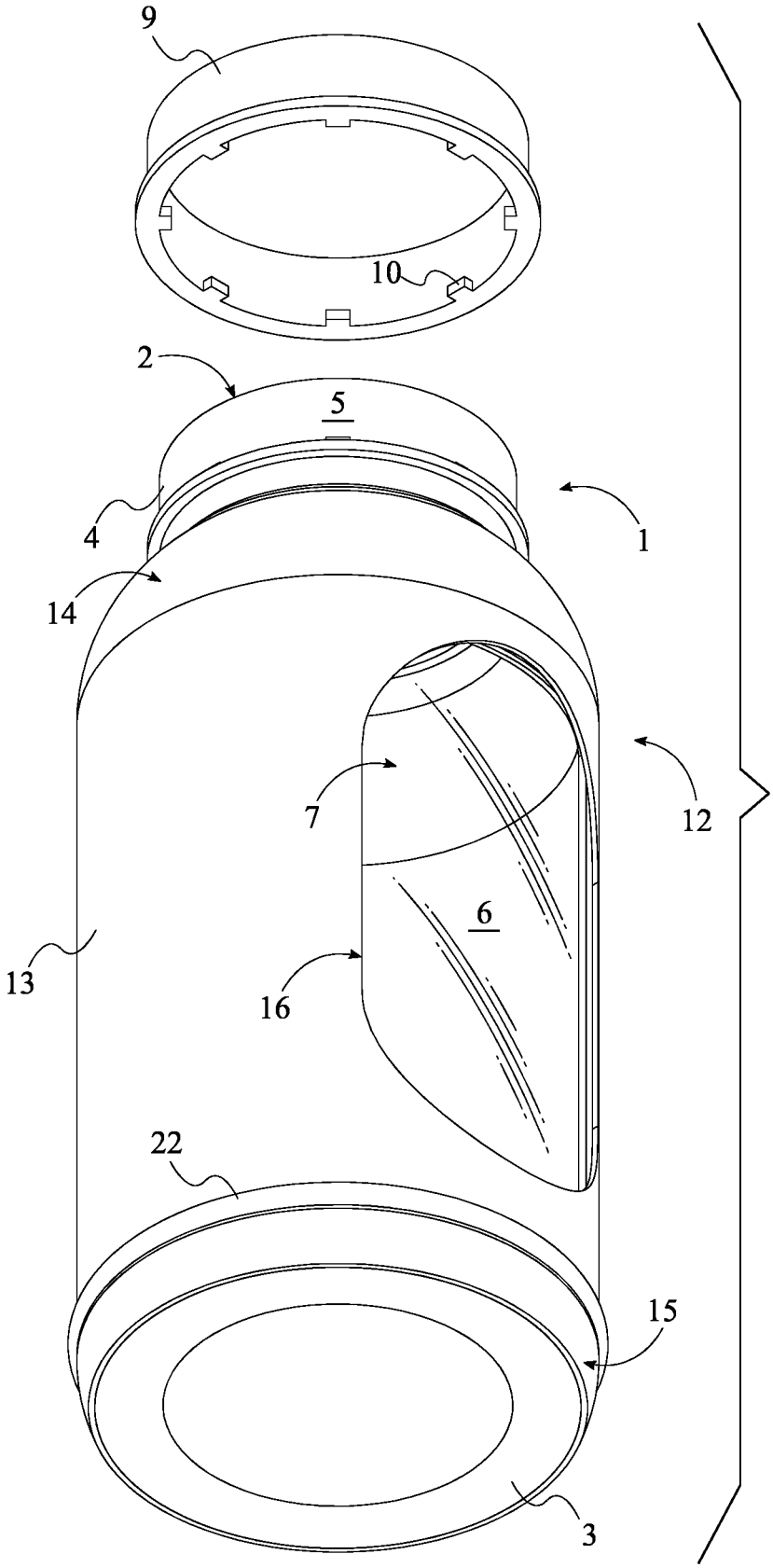
FIG. 2 is a bottom exploded perspective view showing the sealing lid separated from the display container.

The present invention is a container for selective display that enables users to store perishable items under controlled conditions. As can be seen in FIGS. 1 and 2, the present invention may comprise a display container 1 and at least one obstruction mechanism 12. The display container 1 is designed to store items under controlled conditions, such as within a specified temperature range, lumen count, humidity levels, etc. The display container 1 further facilitates users to monitor and control the different environmental variables inside. The at least one obstruction mechanism 12 enables users to keep the contents inside the display container 1 from being exposed to external light while also facilitating the selective view inside the display container 1 to inspect the conditions of the contents. Thus, the user does not greatly affect the conditions within the display container 1 when inspecting the contents.

The general configuration of the aforementioned components allows the present invention to store items under predetermined ideal conditions to prevent the contents from perishing. As can be seen in FIGS. 1 and 2, the display container 1 comprises an open container end 2, a closed container end 3, a lateral wall 4, at least one window 7, and a sealing lid 9. The lateral wall 4 comprises an outer wall surface 5 and an inner wall surface 6 due to the thin-walled structure of the display container 1. The open container end 2 is positioned opposite to the closed container end 3 about the display container 1 to provide enough storage space to hold a predetermined amount of the items inside. The lateral wall 4 is positioned in between the open container end 2 and the closed container end 3 to form a closed structure that can only be accessed through the open container end 2. The at least one window 7 is integrated into the lateral wall 4 to enable users to look inside the display container 1. The at least one obstruction mechanism 12 is positioned adjacent to the outer wall surface 5 so that the at least one obstruction mechanism 12 can be externally engaged by the user to reveal or conceal the at least one window 7. In addition, the at least one obstruction mechanism 12 is operatively mounted to the lateral wall 4, wherein the at least one obstruction mechanism 12 is used to selectively cover the at least one window 7 to prevent light from entering the display container 1. Further, the sealing lid 9 is hermetically attached to the open container end 2 to seal the contents within the display container 1 and prevent airflow through the sealing lid 9 which can alter the conditions inside the display container 1.

Figure 3:
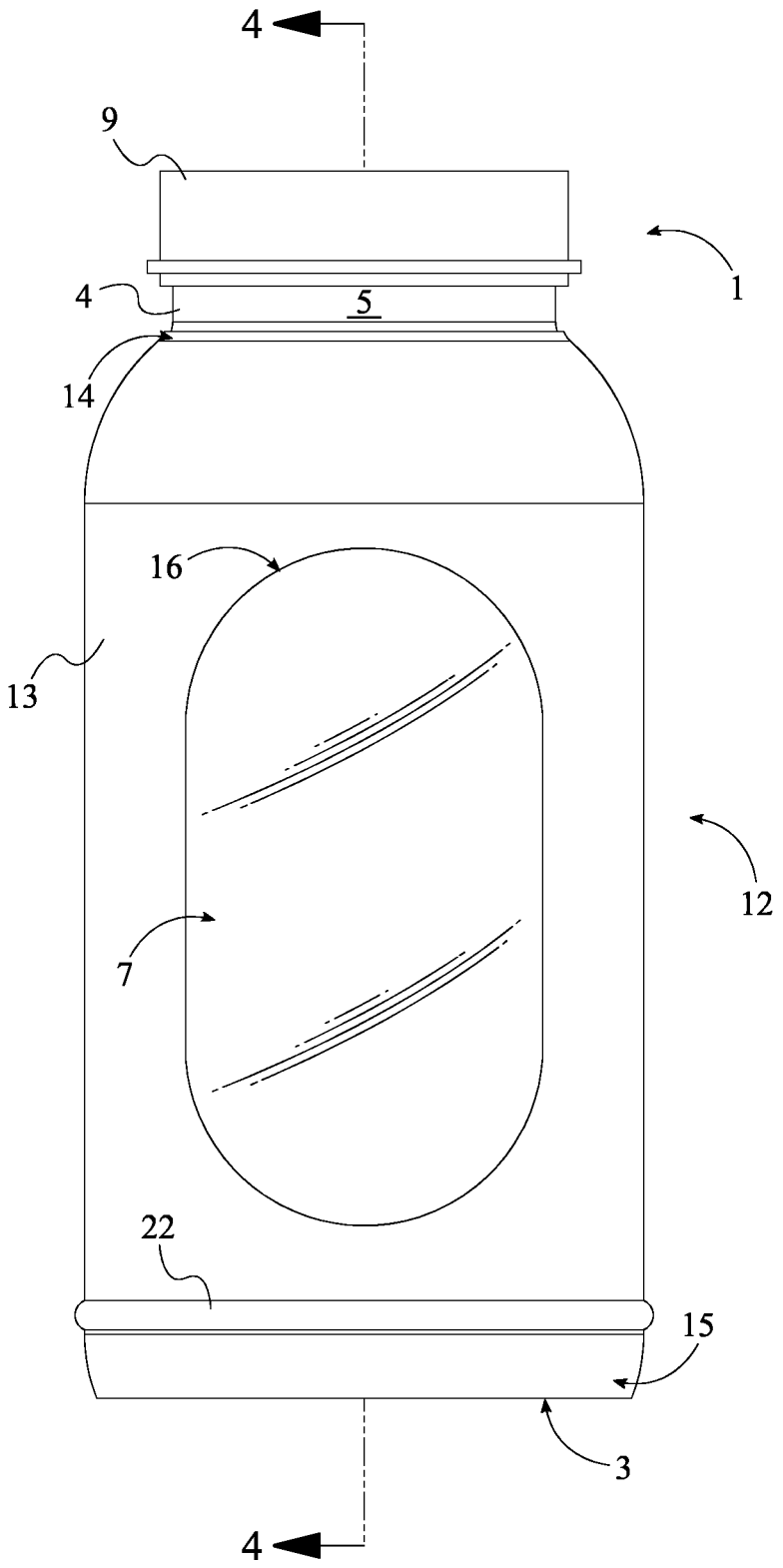
FIG. 3 is a front view showing the sealing lid attached to the open container end.
Figure 4:
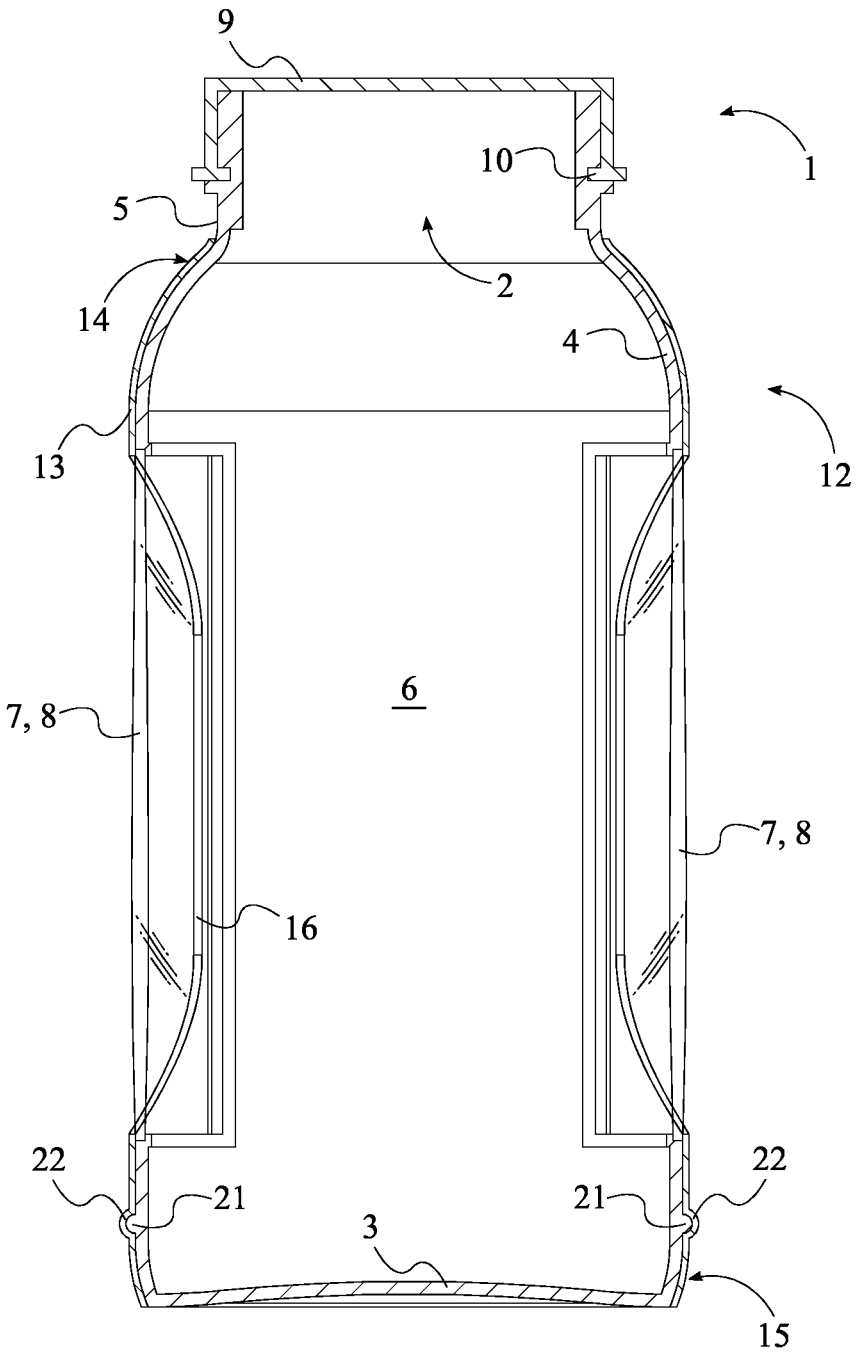
FIG. 4 is a vertical cross-sectional view taken in the direction of line 4-4 in FIG. 3 showing the interior of the display container.

To enable the user to view all the contents within the display container 1, the at least one window 7 is centered along the lateral wall 4 so that the user can view the whole interior of the display container 1. As can be seen in FIGS. 3 and 4, the at least one window 7 is positioned offset to the open container end 2 to not obstruct with the operation of the sealing lid 9. In addition, the at least one window 7 is positioned offset to the closed container end 3. Thus, the at least one window 7 provides a clear view to the user to see the stored contents inside the display container 1. In some embodiments, the display container 1 may comprise multiple windows arranged about the lateral wall 4 to enable the user to inspect the contents within the display container 1 from different angles around the display container 1.

Furthermore, to enable the user to clearly and closely inspects the contents within the display container 1, the at least one window 7 may include different means to enhance the view into the display container 1. As can be seen in FIGS. 3 and 4, the at least one window 7 is a convex lens 8 that magnifies the view into the display container 1. Thus, the user can inspect the contents within the display container 1 and clearly see all aspects of the contents for different purposes, such as to help the user identify the contents or inspect the condition of the contents inside the display container 1. In other embodiments, the present invention may utilize different means to facilitate the inspection of the contents within the display container 1, such as using integrated lighting within the display container 1.

Figure 5:
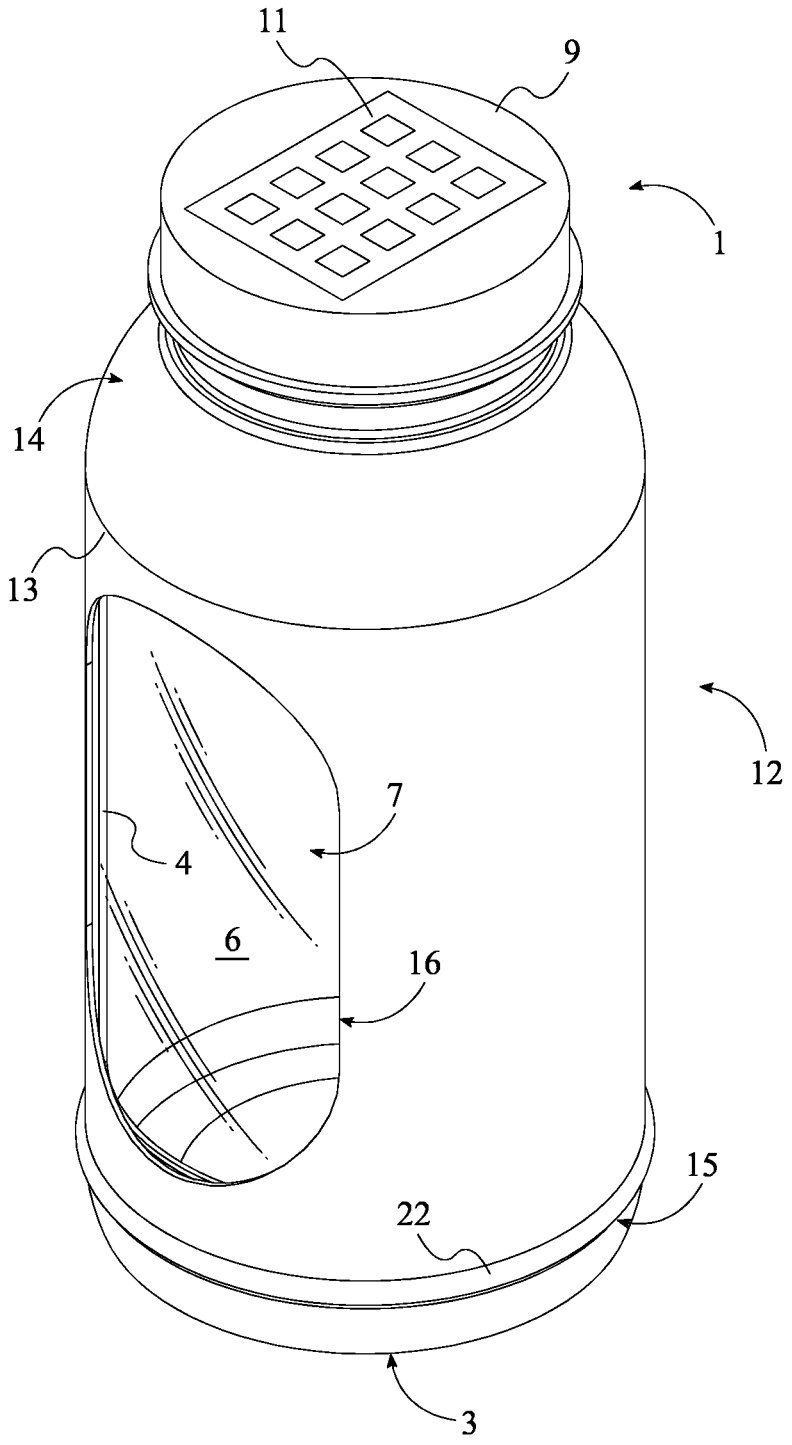
FIG. 5 is a top perspective view showing the display container and the at least one obstruction mechanism in a contents-revealing configuration.

The present invention also provides means to prevent unauthorized access to the contents stored within the display container 1. The present invention may further comprise a lid locking mechanism 10 to shut the sealing lid 9 close. As can be seen in FIGS. 1, 2, and 5, the lid locking mechanism 10 comprises a user-entry pad 11 which enables the user to enter a key that locks and unlocks the lid locking mechanism 10. The user-entry pad 11 is externally connected onto the sealing lid 9 to keep the user-entry pad 11 accessible to the user. In addition, the lid locking mechanism 10 is operatively integrated between the sealing lid 9 and the open container end 2, wherein the lid locking mechanism 10 is used to selectively lock the sealing lid 9 onto the open container end 2 and prevent unauthorized users from accessing the contents. For example, the lid locking mechanism 10 may be a mechanism designed to prevent the removal of the sealing lid 9 from the open container end 2. Further, the user-entry pad 11 can include different mechanical or electronic mechanisms that use different keys to engage or disengage the lid locking mechanism 10. For example, the user-entry pad 11 can be an alphanumeric keypad where the user enters a predetermined alphanumeric key to lock or unlock the sealing lid 9. In other embodiments, the user-entry pad 11 can utilize a traditional physical key to operate the lid locking mechanism 10. Furthermore, the user-entry pad 11 can be a biometric lock which utilizes biometrics, such as a fingerprint, to lock or unlock the sealing lid 9.

Figure 7:
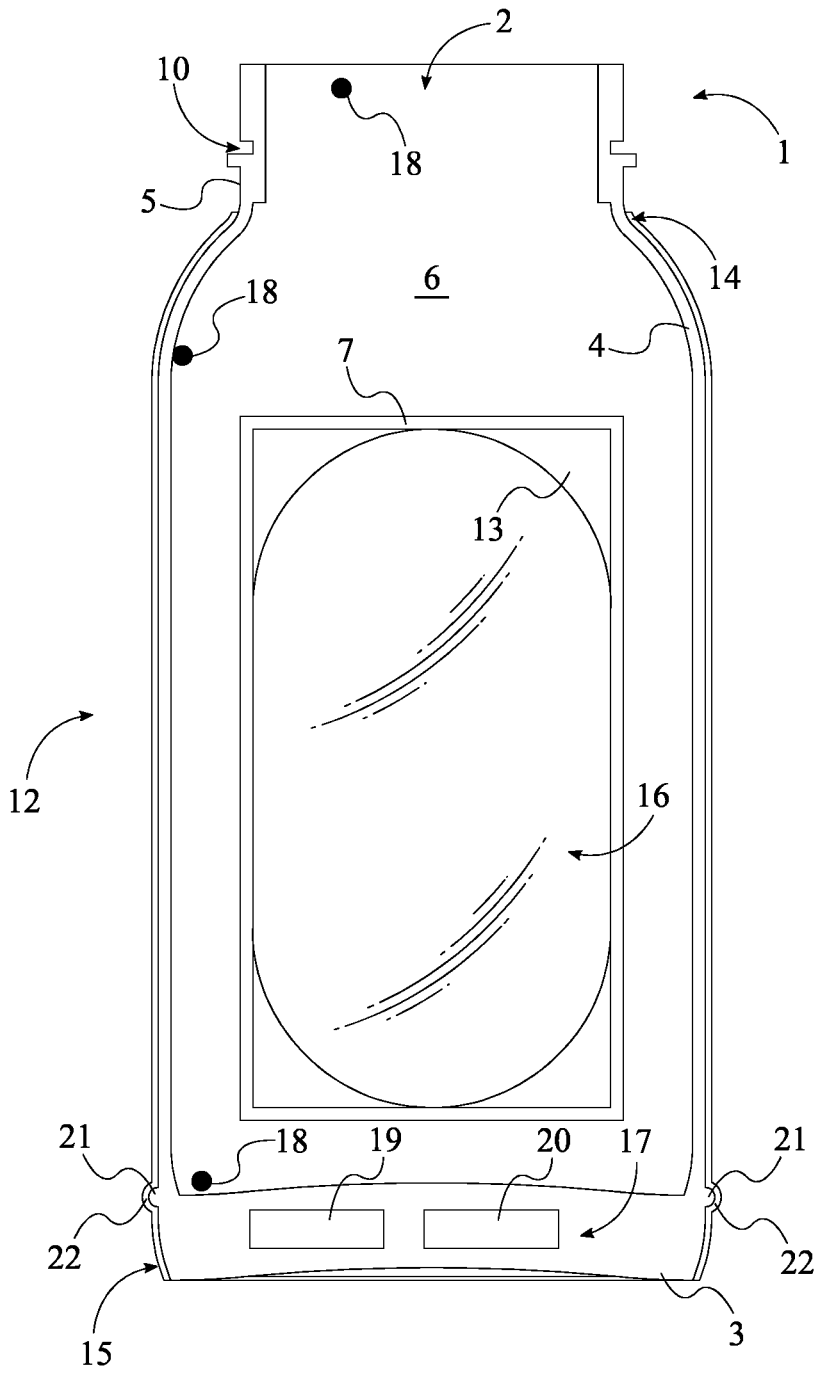
FIG. 7 is a schematic view of the display container showing the environmental control system.
Figure 8:
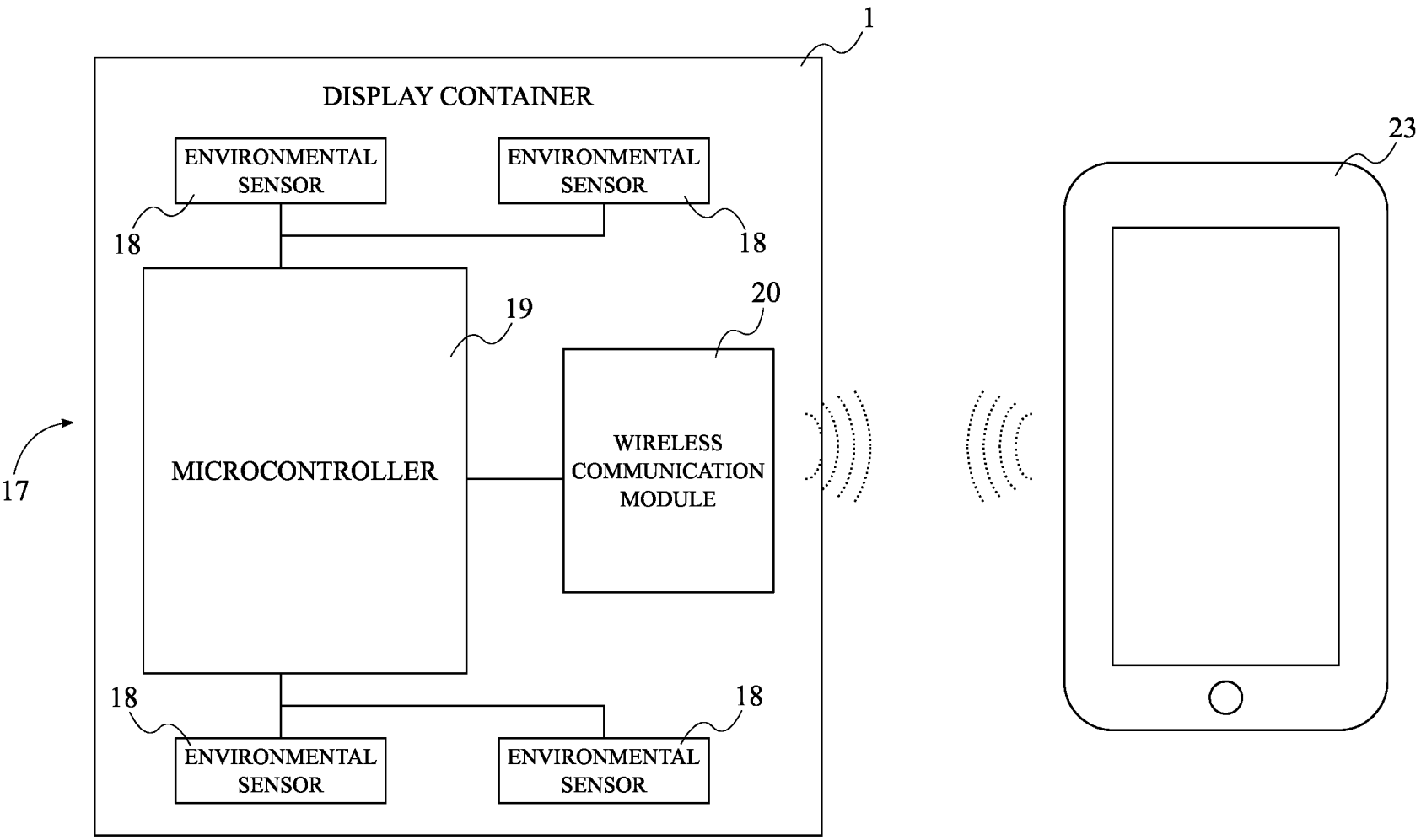
FIG. 8 is a schematic view showing the wireless capabilities of the environmental control system.

To enable accurate and constant monitoring and control of the conditions within the display container 1, the present invention may further comprise an environmental control system 17. As can be seen in FIGS. 7 and 8, the environmental control system 17 comprises a plurality of environmental sensors 18, a microcontroller 19, and a wireless communication module 20. The plurality of environmental sensors 18 is mounted within the display container 1 to monitor different environmental variables inside the display container 1. For example, the plurality of environmental sensors 18 may include a light sensor, a temperature sensor, or a humidity sensor to respectively monitor the light exposure of the contents, the temperature inside the display container 1, or the humidity inside the display container 1 to ensure that the contents are preserved in ideal conditions. The microcontroller 19 and the wireless communication module 20 are integrated into the display container 1 so that the contents are kept separate from the microcontroller 19 and the wireless communication module 20. In addition, the microcontroller 19 is electronically connected to each of the plurality of environmental sensors 18 and the wireless communication module 20 so that the sensor data from each of the plurality of environmental sensors 18 is collected by the microcontroller 19 before being transmitted to the wireless communication module 20. Then, the wireless communication module 20 can transmit the sensor data to a remote electronic wireless device 23 from which the user can monitor the sensor data. In some embodiments, the microcontroller 19 and the wireless communication module 20 may enable the user to remotely lock or unlock the lid locking mechanism 10. The lid locking mechanism 10 may be electronically connected to the microcontroller 19 to receive signals transmitted from the electronic wireless device 23 through the wireless communication module 20. Thus, the user can remotely disengage the lid locking mechanism 10 as desired to give access to the contents within the display container 1 to other users.

Figure 6:
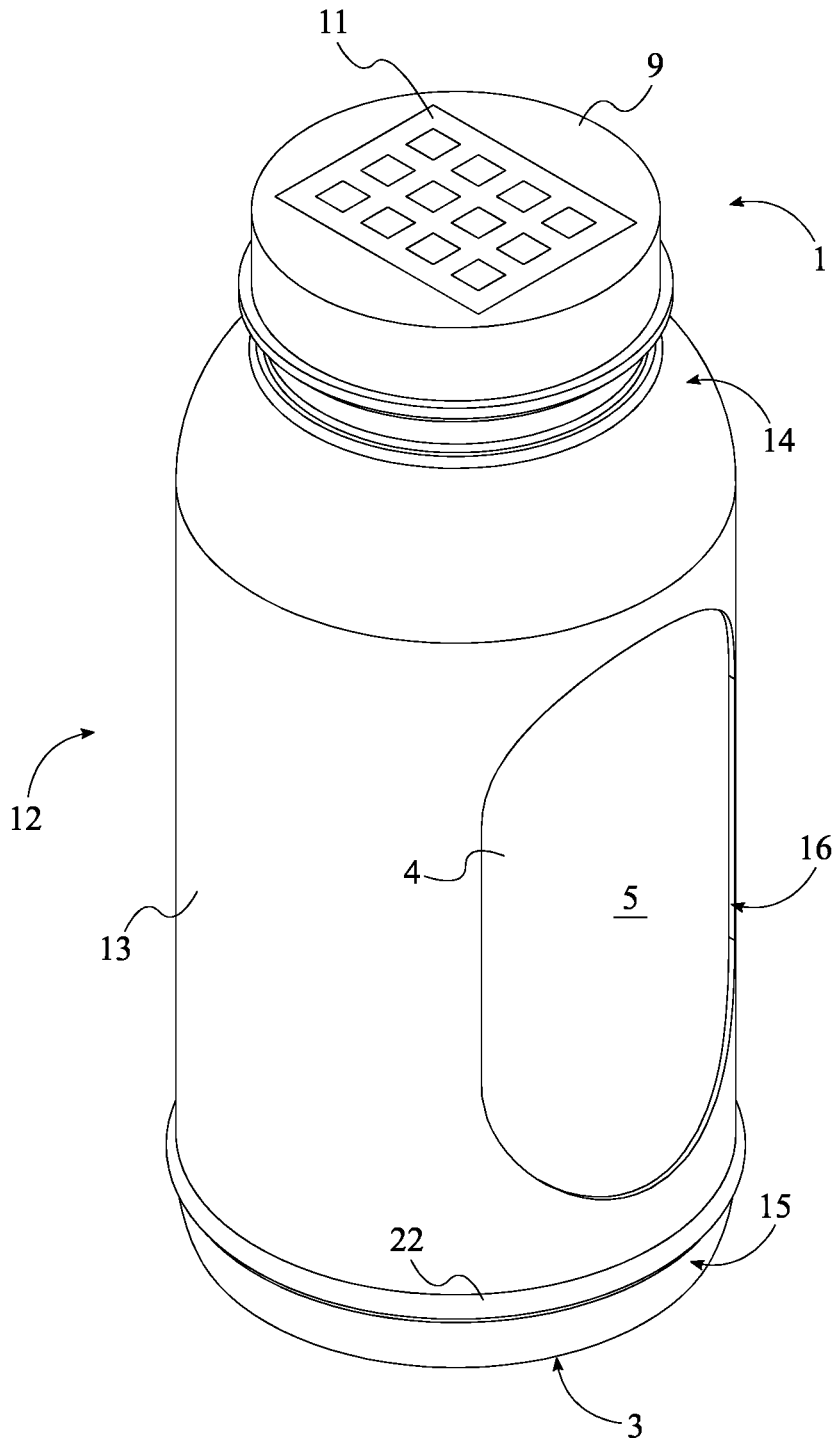
FIG. 6 is a top perspective view showing the display container and the at least one obstruction mechanism in a contents-hiding configuration.

The at least one obstruction mechanism 12 can utilize different mechanisms to enable the selective revealing and concealing of the contents through the at least one window 7. As can be seen in FIGS. 5 and 6, the at least one obstruction mechanism 12 may comprise an opaque sleeve 13 designed to selectively cover the at least one window 7. The opaque sleeve 13 comprises a first open end 14, a second open end 15, and at least one sleeve opening 16. The first open end 14 is positioned opposite to the second open end 15 about the opaque sleeve 13 due to the elongated structure of the opaque sleeve 13. The opaque sleeve 13 is also rotatably mounted about the lateral wall 4 so that the opaque sleeve 13 can be rotated about the display container 1. The first open end 14 is positioned in between the open container end 2 and the at least one window 7 so that the opaque sleeve 13 does not obstruct with the sealing lid 9. In addition, the second open end 15 is positioned in between the at least one window 7 and the closed container end 3 so that there is no friction between the second open end 15 and the closed container end 3. Furthermore, the at least one sleeve opening 16 is positioned in between the first open end 14 and the second open end 15 so that the at least one sleeve opening 16 can match the position of the at least one window 7 as the opaque sleeve 13 is rotated about the display container 1.

In some embodiments, the rotation of the opaque sleeve 13 can be controlled through the microcontroller 19 and the wireless communication module 20. The opaque sleeve 13 may comprise a sleeve rotation mechanism to mechanically rotate the opaque sleeve 13 around the lateral wall 4. The sleeve rotation mechanism can be a mechanical mechanism such as a servo assembly externally connected onto the lateral wall 4. The sleeve rotation mechanism engages with the opaque sleeve 13 to rotate the opaque sleeve 13 around the display container 1. To enable the remote or automatic operation of the sleeve rotation mechanism, the sleeve rotation mechanism is electronically connected to the microcontroller 19 to receive command signals that activate the sleeve rotation mechanism to cause the rotation of the opaque sleeve 13. The user can transmit rotation commands from the electronic wireless device 23 via the wireless communication module 20 to the microcontroller 19 which signals the sleeve rotation mechanism to engage accordingly. The microcontroller 19 may also automatically engage the sleeve rotation mechanism to control the conditions within the display container 1. For example, if the plurality of environmental sensors 18 measures a temperature outside the predetermined temperature range within the display container 1, the microcontroller 19 may engage the sleeve rotation mechanism to reposition the opaque sleeve 13 to reveal or cover the at least one window 7 to raise or lower the temperature within the display container 1, respectively.

The at least one sleeve opening 16 can be repositioned to different locations around the lateral wall 4 by rotating the opaque sleeve 13 around the display container 1. As can be seen in FIG. 5, the display container 1 and the opaque sleeve 13 are in a contents-revealing configuration. In the contents-revealing configuration, the at least one sleeve opening 16 is concentrically aligned with the at least one window 7. Thus, the user can inspect the contents inside the display container 1 through the at least one sleeve opening 16 and the at least one window 7. In contrast, the opaque sleeve 13 can be repositioned so that the display container 1 and the opaque sleeve 13 are in a contents-hiding configuration. As can be seen in FIG. 6, the at least one sleeve opening 16 is positioned offset from the at least one window 7 to hide the at least one window 7 behind the solid portions of the opaque sleeve 13. Thus, the user is unable to see the contents inside the display container 1.

Furthermore, to guide the rotation of the opaque sleeve 13, the present invention may comprise an annular protrusion 21. As can be seen in FIGS. 3 and 4, the opaque sleeve 13 may further comprise an annular groove 22 to engage with the annular protrusion 21. The annular protrusion 21 is concentrically connected around the lateral wall 4 to keep the opaque sleeve 13 axially rotating about the display container 1. The annular protrusion 21 is also positioned in between the at least one window 7 and the closed container end 3. Likewise, the annular groove 22 is positioned in between the at least one sleeve opening 16 and the second open end 15 to match the position of the annular protrusion 21. In addition, the annular protrusion 21 is slidably engaged into the annular groove 22. Thus, the opaque sleeve 13 can rotate about the display container 1 but cannot be moved vertically along the lateral wall 4.

In an alternate embodiment, the at least one obstruction mechanism 12 may comprise a window shade designed to selectively cover the at least one window 7. Unlike the opaque sleeve 13, the window shade can be part of the lateral wall 4 instead of being rotatably mounted about the lateral wall 4. The lateral wall 4 may further comprise a shade hole to receive the deployable window shade. Moreover, the window shade comprises a first shade end, a second shade end, and a shade stopper. The shade hole is positioned within the lateral wall 4, in between the inner wall surface 6 and the outer wall surface 5. The shade hole is also positioned contiguous to the at least one window 7 as the shade hole and the at least one window 7 comprise matching widths. The shade hole is also positioned adjacent to the outer wall surface 5 so that the at least one window 7 does not obstruct the movement of the window shade. In addition, the shade hole traverses into the lateral wall 4, a distance long enough to receive most of the window shade. The first shade end is positioned opposite to the second shade end about the window shade to provide enough cover to the at least one window 7. The first shade end is slidably mounted onto the at least one window 7. On the other hand, the second shade end is slidably mounted within the shade hole. Thus, the window shade can be slid into and out of the shade hole. Further, the shade stopper is externally connected onto the window shade, opposite to the at least one window 7. The shade stopper is also positioned adjacent to the first shade end. Therefore, the shade stopper prevents the window shade from fully sliding into the shade hole. The shade stopper also works as a handle to enable the user to manually pull the window shade out of the shade hole or slide the window shade back into the shade hole.

Like the opaque sleeve 13, the display container 1 and the window shade can be in a contents-revealing configuration. The window shade is slid into the shade hole, up to the shade stopper, thus revealing the contents within the display container 1. Further, the display container 1 and the window shade can be in a contents-hiding configuration. The window shade is positioned coextensive to at least one window 7, thus fully covering the at least one window 7 and preventing the user to inspect the contents within the display container 1. Furthermore, the window shade can be remotely or automatically operated, like the opaque sleeve 13. The window shade may further comprise a shade sliding mechanism that mechanically slides the window shade into or out of the shade hole. The shade sliding mechanism can be a servo assembly or a linear actuator mounted within the shade hole so that the window shade can be slid into and out of the shade hole. The shade sliding mechanism is electronically connected to the microcontroller 19 to receive remote commands through the wireless communication module 20. Thus, the user can remotely position the window shade in the contents-revealing configuration or the contents-hiding configuration to reveal or hide the contents within the display container 1, respectively.

In other embodiments, the present invention may further comprise a measuring scoop. The measuring scoop helps the user to retrieve a desired amount of the contents inside the display container 1. The measuring scoop may comprise a scoop head, a scoop handle, a measuring mechanism, and a measuring display. The scoop head is terminally mounted onto the scoop handle to enable the user to retrieve the contents from the display container 1 without touching the contents. The scoop head is designed to be able to collect the contents within the display container 1 and hold the contents on the scoop head while being transported to another container or package. The measuring mechanism is operatively integrated into the scoop head to measure the weight of the contents being held on the scoop head. The measuring display is externally connected onto the scoop handle. The measuring display is also electronically connected to the measuring mechanism to display the measured weight of the contents being held on the scoop head.

Although the invention has been explained in relation to its preferred embodiment, it is to be understood that many other possible modifications and variations can be made without departing from the spirit and scope of the invention as hereinafter claimed.

What is claimed is:

1. A container for selective display comprising:

a display container;

at least one obstruction mechanism;

a lid locking mechanism;

the display container comprising an annular protrusion, an open container end, a closed container end, a lateral wall, at least one window, and a sealing lid;

the lateral wall comprising an outer wall surface and an inner wall surface;

the open container end being positioned opposite to the closed container end about the display container;

the lateral wall being positioned in between the open container end and the closed container end;

the at least one window being integrated into the lateral wall;

the at least one obstruction mechanism being positioned adjacent to the outer wall surface;

the at least one obstruction mechanism being operatively mounted to the lateral wall, wherein the at least one mechanism is used to selectively cover the at least one window;

the sealing lid being hermetically attached to the open container end;

the at least one window being positioned offset to the open container end;

the at least one window being positioned offset to the closed container end;

the lid locking mechanism comprising a user-entry pad;

the user-entry pad being externally connected onto the sealing lid;

the lid locking mechanism being operatively integrated between the sealing lid and the open container end, wherein the lid locking mechanism is used to selectively lock the sealing lid onto the open container end;

an environmental control system;

the environmental control system comprising a plurality of environmental sensors, a microcontroller, and a wireless communication module;

the plurality of environmental sensors being mounted within the display container;

the microcontroller and the wireless communication module being integrated into the display container;

the microcontroller being electronically connected to each of the plurality of environmental sensors and the wireless communication module;

the at least one obstruction mechanism comprising an opaque sleeve;

the opaque sleeve comprising a first open end, a second open end, and at least one sleeve opening;

the first open end being positioned opposite to the second open end about the opaque sleeve;

the opaque sleeve being rotatably mounted about the lateral wall;

the first open end being positioned in between the open container end and the at least one window;

the second open end being positioned in between the at least one window and the closed container end;

the at least one sleeve opening being positioned in between the first open end and the second open end;

the at least one sleeve opening being concentrically aligned with the at least one window when the display container and the opaque sleeve are in a contents-revealing configuration;

the at least one sleeve opening being positioned offset from the at least one window when the display container and the opaque sleeve are in a contents-hiding configuration;

the opaque sleeve comprising an annular groove;

the annular protrusion being concentrically connected around the lateral wall;

the annular protrusion being positioned in between the at least one window and the closed container end;

the annular groove being positioned in between the at least one sleeve opening and the second open end;

the annular protrusion being slidably engaged into the annular groove; and the plurality of environmental sensors comprising a light sensor, a temperature sensor and a humidity sensor.

2. The container for selective display as claimed in claim 1, wherein the at least one window is a convex lens.

* * * * *